United States Patent [19]

Vogelsberg

[11] 4,339,913

[45] Jul. 20, 1982

[54] DEVICE FOR SZ TWISTING OF TWIST ELEMENTS OF ELECTRIC CABLES AND WIRES

[75] Inventor: Dieter Vogelsberg, Coburg, Fed. Rep. of Germany

[73] Assignee: Siemens Aktiengesellschaft, Munich, Fed. Rep. of Germany

[21] Appl. No.: 140,742

[22] Filed: Apr. 16, 1980

[30] Foreign Application Priority Data

Apr. 20, 1979 [DE] Fed. Rep. of Germany ..... 2916520

[51] Int. Cl.[3] ..... H01B 13/04

[52] U.S. Cl. ..... 57/294; 57/293

[58] Field of Search ..... 57/293, 294; 140/149

[56] References Cited

U.S. PATENT DOCUMENTS

| | | | |
|---|---|---|---|
| 3,407,588 | 10/1968 | Feese | 57/294 X |
| 3,426,519 | 2/1969 | Unger et al. | 57/294 X |
| 3,475,893 | 11/1969 | Sugi et al. | 57/294 X |
| 3,491,525 | 1/1970 | Sugi | 57/294 |
| 4,056,925 | 11/1977 | Vogelsberg | 57/293 |
| 4,196,576 | 4/1980 | Vogelsberg | 57/294 |
| 4,214,430 | 7/1980 | Vogelsberg et al. | 57/294 X |
| 4,214,432 | 7/1980 | Scheidt | 57/294 X |
| 4,224,788 | 9/1980 | Vogelsberg | 57/294 |

FOREIGN PATENT DOCUMENTS

| | | |
|---|---|---|
| 1515730 | 6/1971 | Fed. Rep. of Germany . |
| 1665552 | 3/1972 | Fed. Rep. of Germany . |
| 2202643 | 8/1973 | Fed. Rep. of Germany . |
| 2412514 | 9/1975 | Fed. Rep. of Germany . |
| 2510643 | 9/1976 | Fed. Rep. of Germany . |

*Primary Examiner*—John Petrakes

*Attorney, Agent, or Firm*—Kenyon & Kenyon

[57] ABSTRACT

To be able to correct irregularities in the length of lay, which result from the reversal of the twisting device in SZ twisting devices with very large storage capacity, a post-twisting device is arranged after the SZ twisting device, the post-twisting device including a retwisting disc with an equalization section in the back thereof. The length of the equalization section is at least five times the resulting length of lay; the speed of rotation of the post-twisting device is equal to the difference between two successive speed steps of the SZ twisting device and direction of rotation of the post-twisting device is changed in the same rhythm as the rotary motion of the SZ twisting device.

5 Claims, 5 Drawing Figures

DEVICE FOR SZ TWISTING OF TWIST ELEMENTS OF ELECTRIC CABLES AND WIRES

BACKGROUND OF THE INVENTION

1. Field of the Invention

This invention relates to twisting technology for electric cables and wires and deals with the mechanical design of a twisting machine with a view toward obtaining a length of lay as uniform as possible, especially in the vicinity of the reversal points of the twist direction.

2. Description of the Prior Art

In SZ twisting of stranding elements of electric cables and wires by means of revolving twisting devices which change their rotary motion at intervals, the quality of the SZ twist (no tumbling of conductors, uniform length of lay in the vicinity of the reversal points of the twist direction, short reveral spots) depends essentially on the magnitude of the distances of fixed points, between which the twisting processes take place, and on the reversal times for changing the rotary motion of the revolving parts. The distances between the fixed points are very large, for instance, in SZ twisting machines which operate with stationary concentrated accumulators and revolving twisting heads (German Patent No. 16 65 536, DE-OS No. 16 65 911, DE-OS No. 16 85 842), but are very small in SZ twisting machines with unconcentrated longitudinal accumulators, so-called linear accumulators or straight accumulators (journal "Drahtwelt", 1977, pages 209 to 212). In unconcentrated longitudinal accumulators, the mentioned reversal times are very small, but the storage capacity in such storage devices is also relatively small. In rotating concentrated longitudinal accumulators, on the other hand, relatively long reversal times are obtained especially if the storage capacity is chosen to be very large (DE-AS 15 15 730).

Short reversal times in the SZ twisting of twist elements can also be achieved if the twisting is not accomplished by means of concentrated or unconcentrated longitudinal accumulators, in which the resulting twisting of the twisted material is obtained from the superposition of a first and at least one second twist, but by means of an oscillating twisting disc, which is optionally preceded by an equalization section (DE-OS No. 24 54 777).

To improve the quality of SZ twisting (especially the elimination of conductor tumbling), it is already known to arrange a hole disc (rotating or oscillating lay plate) through which the twisted twist elements pass after the SZ twisting machine. This hole disc untwists the twist elements and retwists them immediately. The rotary motion of this retwisting disc is either brought about by the twist elements themselves, or the retwisting disc is driven, at least briefly, when the twist direction changes. If, however, the retwisting disc is driven continuously at constant speed with the same running time in the one or the other direction as the twisting devices, automatic equalization of different lengths of lay, which are caused by the fact that for changing the direction of rotation of the twisting device, the latter must be braked to zero and subsequently accelerated again to the maximum speed, can be accomplished (DS-OS No. 25 10 643, DE-AS No. 16 65 552, DE-OS No. 22 02 643, DE-OS No. 24 12 514).

SUMMARY OF THE INVENTION

The present invention starts out from a device for the SZ twisting of twist elements of electric cables and wires to form an SZ twisted unit, where this device consists of one or more twisting devices which are arranged between a first and a last twisting point and rotate with a stepwise alternating speed or direction of rotation, and of an accumulator device, which is arranged between the first and the last twisting point and is separate from the twisting device or is integrated therewith, for the twist elements which have been twisted at least a first time. It is an object of the present invention to develop such a device so that, if the accumulator has a very large storage capacity of more than 50 m or has more than 200 twist lays, a high quality of SZ twisting is ensured, i.e., short reversal points of the twist direction and uniform length of lay even in the vicinity of the reversal points.

In one solution of this problem, the present invention is based on the fundamental consideration of splitting the SZ-twisting process of a twisting stage into a first twisting operation with high twisting output but lesser twisting quality, and a second twisting operation with lower twisting output but high twisting quality. Thus, according to the present invention a retwisting disc is arranged immediately after or before the last twisting point. The retwisting disc has one or two associated twisting closures, forming twisting points, which can be driven in alternating directions of rotation and through which the SZ twisted twist elements pass. In other words, there is then a first or pre-twisting device and, in series, following the first twisting device, a second or post twisting device, including a retwisting disc with which there are associated twisting closers. The free distance of the retwisting disc from the last twisting point or from the last part of the twisting device which frictionally grips and twists the twist elements from the outside, (which in effect acts as a twisting point) is at least five times the resulting SZ length of lay of the stranded material. Furthermore, the speed of rotation of the retwisting disc is equal to the difference between two successive speed steps of the revolving twisting device, and the direction of rotation of the retwisting disc can be changed in the same rhythm as the rotary motion of the twisting device or in the same rhythm as the change from a speed reduction to a speed increase of the twisting device or vice-versa.

In an SZ twisting device designed in this manner, the twisting device itself, which consists of the twisting heads or hoops and the accumulator, will be called the pre-twisting device. The retwisting disc, which is arranged at a distance, will be called a post-twisting device. Then, the pre-twisting device contains the main SZ accumulator, the size of which is determined by the desired twist reversal spacing in the twisted material. This pre-twisting device can be constructed relatively simply with drives of moderate power. Relatively long untwisted sections are then obtained at the places where the twist changes. In the post-twisting device, a single retwisting disc, driven alternatingly to the right and to the left, then provides for a precise formation of the twist reversal points and for constant lengths of lay in the S and Z sections. Due to the fact that the retwisting disc is arranged at a free distance from the last twisting point or from the last part of the twisting device which frictionally grips from the outside and twists the twist elements, the retwisting disc is preceded by a straight accumulator which at times must accept as many twisting lays as are to be additionally generated by the post-twisting device.

In the new twisting machine, the expenditure for fast driving means, short distances etc., need be made only once in the post-twisting device. This results in a cost-effective machine design.

By way of example, it will be assumed for an SZ twisting machine which consists of a concentrated rotating longitudinal accumulator such as is known from DE-AS No. 15 15 730 and has a storage capacity of about 250 twisting lays, that three twisting lays are always lost in the one and in the other direction when the direction of rotation changes. Six twisting lays would then have to be produced subsequently by the subsequent twisting device within a section of constant twist direction. A somewhat larger number of twisting lays would have to be generated subsequently if the SZ twisting is accomplished by means of revolving twisting heads, as is known for German Pat. No. 16 65 536.

If within the scope of the new SZ twisting device, twisting hoops are used which rotate in a circle around an intermediate accumulator, it is advisable to arrange the post-twisting device at the output of the second twisting hoop and to preferably integrate it into this twisting hoop. The procedure should be to arrange the retwisting disc of the post-twisting device immediately before the last twisting point, and to arrange the equalization section preceding the retwisting disc so that it follows the last deflection of the twisted material within the twisting hoop. In that case, the rotary motion of the retwisting disc of the post-twisting device can be changed synchronously with the rotary motion of the twisting hoops. In this connection, the equalization section preceding the retwisting disc must be taken into account for the storage capacity of the total twisting device.

The post-twisting device provided under the scope of the present invention can be used to particular advantage if it is used in combination with a pre-twisting device such as is described in German Patent Application P No. 29 00 729.2, and in which a basically straight accumulator is subdivided into several parallel accumulator subsections which are connected to each other via 180° deflection devices. In this previously proposed SZ twisting device, a rotating twisting head is arranged at both the beginning and the end of each accumulator subsection. Within the scope of the present invention, the post-twisting device can be integrated into such a pre-twisting device in such a manner that the retwisting disc is integrated into the last twisting head, i.e., into the rotating twisting head which is arranged at the end of the last accumulator subsection. In that case the last accumulator subsection acts at the same time as an equalization section for the retwisting disc.

DETAILED DESCRIPTION OF THE INVENTION

Figure 1:
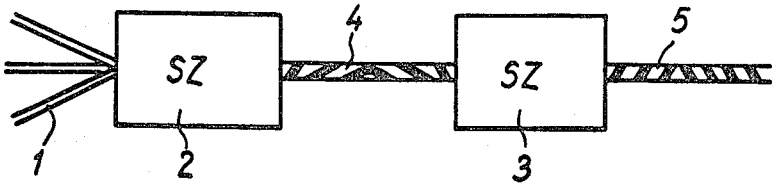
FIG. 1 is a diagrammatic presentation of an SZ twisting device designed according to the present invention.

FIG. 1 shows diagrammatically the SZ twisting of twist elements 1 to form a twisted unit 5. The elements to be twisted are first SZ twisted into a stranded assembly 4 by means of the main or pre-twisting device 2. Behind the main twisting device 2, the post-twisting or correction twisting device 3 is arranged which has the sole purpose of eliminating faults in the specified geometry of the twisted assembly 4 in the S and Z sections as well as at the twist reversal points in between. In such a subdivision of the SZ twisting into a pre-twisting and a post-twisting operation, the requirements for the post-twisting device 2 regarding the geometric distances between the stationary and rotating twisting heads are less stringent; also, certain retwisting processes at stationary deflection points within the twisting device can be tolerated. Also, the otherwise desirably changeable process parameters such as, in particular, the speed and/or the direction of rotation of the twisting device can be changed more slowly, whereby the cost of the drive and the shock-like stress of many machine parts are reduced.

Only in the correction or post-twisting device 3 must the twisting or retwisting tool, which is provided there only once, be reversed quickly between closely adjacent points, whereby the overall cost of the machine is reduced considerably.

The SZ-twisting device 2 can therefore be considered as a pre-twisting device, by which for instance, 99% of the necessary S and Z twisting lays are produced with moderate accuracy requirements. The post-twisting device 3 operates as a post-twisting device and generates the remaining percentage of twisting lays in the vicinity of the twist reversal points and provides for uniform distribution of the twisting lays.

Figure 2:
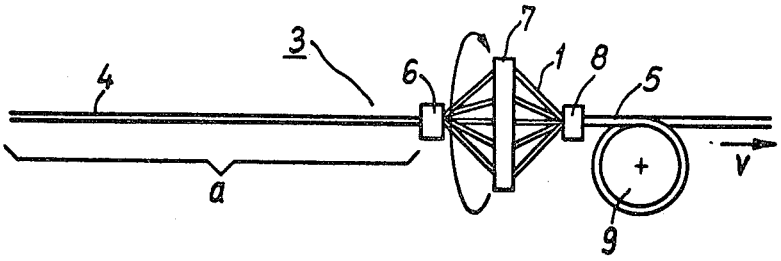
FIG. 2 shows the post-twisting device equipped with a retwisting disc.

FIG. 2 shows the mechanical design of the post-twisting device 3. Post-twisting device 3 includes a retwisting disc 7 which rotates with alternating direction and constant speed of rotation and with which a twisting closer 6 (at which untwisting takes place) is associated on the one side and a twisting closer 8 on the other side. For the twisted material passing through the post-twisting device from left to right, the equalizing section a is arranged ahead of the twisting closer 6, over which twists exerted backwards by the retwisting disc 7 can be distributed. This equalization section a should be able to accept at least as many lengths of lay as are additionally generated by the retwisting device.

After passing the retwisting disc 7, the individual twist elements 1 are combined in the twisting closer 8 into the final SZ twisted unit 5 and in the process are given precisely their final length of lays, which is given by the pull-off velocity of the twisted assembly and the speed of rotation of the retwisting disc.

In the finally twisted SZ unit 5, the length of the twist reversal points is determined solely by the reversal speed of the retwisting disc 7 and the distance between the twisting closer 8 and the nearest fixed point 10, which is established here, for instance, by a pull-off pulley 9.

The length of the backward equalization section or storage section a depends on the number of twisting lays which must be generated retroactively by the correction device. This length would be, with a final SZ length of lay of 0.3 m, at least 1.5 m and with a final SZ length of lay of 0.1 m at least 0.5 m. Let us assume by way of an example that the pre-twisting device 2 in FIG. 1 always makes S and Z sections 500 m long with a length of lay of s=0.1 m. In the ideal case, each S and Z section would accordingly contain 5000 twisting lays. For reasons of a simple drive, let us assume that in the vicinity of the twist reversal points ±50 twisting lays are always lost due to relatively long reversing times of the twisting device. These twisting lays are made up in the post-twisting device 3, for which purpose a storage section a of about 2 to 10 m length is required. The exact length is determined experimentally and depends on the length of lay which is permitted within the storage section a.

The storage section a and the retwisting disc 7 also have the effect of equalizing twist irregularities which results for instance, in the pre-twisting device, under the influence of torsion inhibiting deflections.

Figure 3:
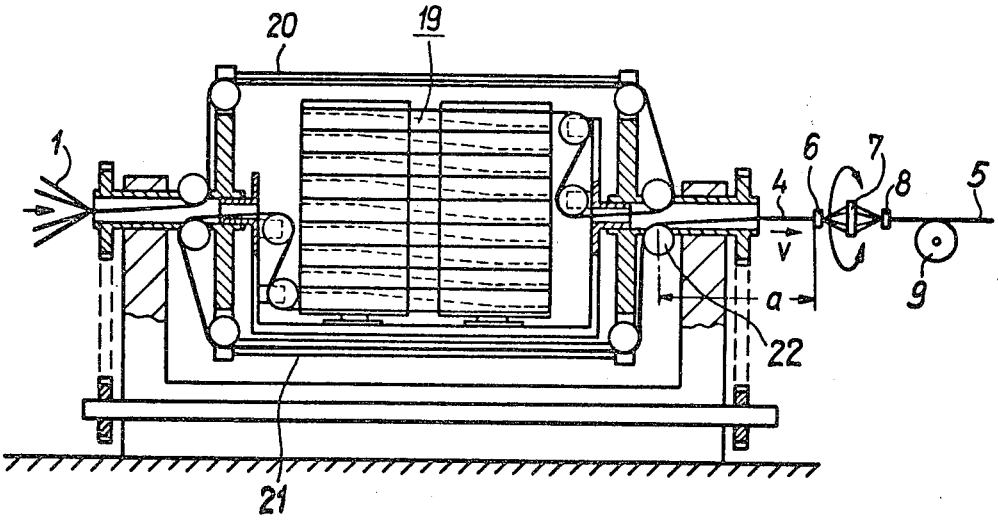
FIG. 3 shows an SZ twisting device with a stationary accumulator and revolving twisting heads as well as an integrated post-twisting device.

An example of a complete pre-twisting and post-twisting device is shown in FIG. 3. The pre-twisting of the twist elements 1 is accomplished by means of twisting hoops 20 and 21 which circle, in a known manner per se, around a stationary intermediate accumulator 19 of large storage capacity (cf. German Pat. No. 16 65 536). Immediately before the last twisting point 9 of the SZ twisting device, is the post twisting device consisting of the untwisting closer 6, the retwisting disc 7 and the twisting closer 8 as well as the equalization section a. The equalization section a corresponds here to the distance between the last deflection pulley 22 within the twisting hoop 21 and the untwisting closer 6.

Figure 4:
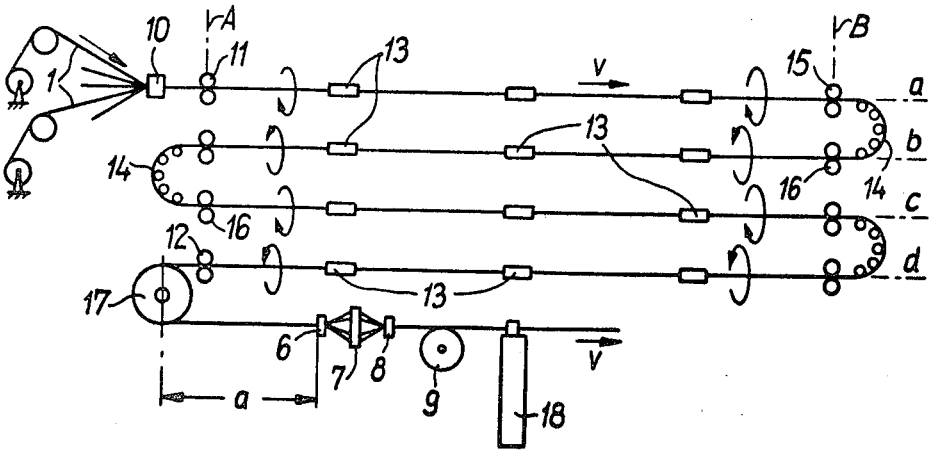
FIGS. 4 and 5 show an SZ twisting device designed as a folded linear accumulator followed by or integrated with the post-twisting device.

The embodiment shown in FIG. 4 is an SZ-twisting machine in which the post-twisting device shown in FIG. 2 is combined with a main twisting device, as is described in German Patent Application P No. 29 00 729.2, and in which a basically straight accumulator is subdivided into several accumulator subsections arranged in the planes a to d, where the individual accumulator subsections are connected to each other successively by deflection devices. Linear folded accumulators formed in this manner consist substantially of twisting heads 11, 12, 15 and 16 as well as the deflection devices 14 and the straight guides 13. The twisting heads are arranged in the vertical planes A and B. The post-twisting device, which again consists of the untwisting closer 6, the retwisting disc 7 and the twisting closer 8 as well as the twisting point 9, is arranged at a distance a behind the last twisting point (pull-off pulley) 17. Immediately behind it, an extruder 18 is arranged by which a plastic sheath is applied to the stranded unit 5.

Figure 5:
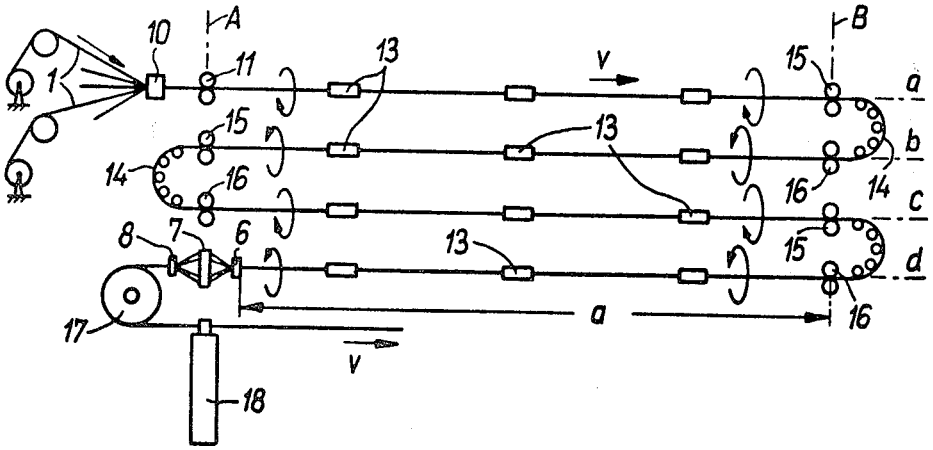

In the variation shown in FIG. 5, the post-twisting device consisting of the untwisting closer 6, the retwisting disc 7 and the twisting closer 8 is integrated into the main twisting device, the twisting head 12 shown in FIG. 4 being replaced by the post-twisting device. In this variation, the last accumulator subsection between the twisting head 16 in plane d and the untwisting closer 6 forms, at the same time, the equalization section a.

What is claimed is:

1. In an apparatus for the SZ-twisting of twist elements of electric cables and wires to form an SZ-twisted unit, including a first twisting device comprising one or more twisting means which are arranged between a first and a last twisting point and revolve in a stepwise alternating manner, and a storage device for the twist elements twisted at least one first time, the storage device having a very large storage capacity, the improvement comprising:

a second twisting device in series with the first twisting device and including, a retwisting disc, adapted to be driven with alternating direction of rotation, through which the SZ-twisted twist elements twisted in the first twisting device pass, and at least one twisting closer point associated with said retwisting disc;

the free distance of said retwisting disc from the last point of contact with the SZ-twisted elements in the first twisting device being at least five times the resulting SZ length of lay, the speed of rotation of said retwisting disc being equal to the difference in speed between two successive steps of said first twisting device; and the direction of rotation of said retwisting disc adapted to be changed in the same rhythm as the change from a speed reduction to a speed increase of the first twisting device or vice versa.

2. The improvement according to claim 1, wherein said first twisting device includes a stationary storage element arranged within first and second rotating twisting hoops, and wherein said retwisting disc is disposed at the exit of the second twisting hoop.

3. The improvement according to claim 1, wherein said first twisting device includes a basically straight accumulator subdivided into several parallel accumulator subsections, a rotating twisting head being arranged at the beginning and at the end of each accumulator subsection, and wherein said retwisting disc is integrated into the last twisting head.

4. The improvement according to claim 1 wherein said second twisting device is located after the last twisting point in said first twisting device.

5. The improvement according to claim 1 wherein said second twisting device is disposed before the last twisting point in said first twisting device.

* * * * *